US006566803B2

(12) United States Patent
Jun et al.

(10) Patent No.: US 6,566,803 B2
(45) Date of Patent: May 20, 2003

(54) CATHODE RAY TUBE WHOSE PANEL PROVIDES INCREASED PROTECTION FROM ELECTRIC SHOCK AND REDUCED EMISSION OF ELECTROMAGNETIC WAVES

(75) Inventors: Yoon-Ho Jun, Suwon (KR); Dong-Sik Zang, Suwon (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 35 days.

(21) Appl. No.: 09/962,613

(22) Filed: Sep. 26, 2001

(65) Prior Publication Data

US 2002/0125813 A1 Sep. 12, 2002

(30) Foreign Application Priority Data

Jan. 5, 2001 (KR) ..... 01-665
Jan. 5, 2001 (KR) ..... 01-666

(51) Int. Cl.[7] ..... H01J 31/00
(52) U.S. Cl. ..... 313/479; 313/313
(58) Field of Search ..... 313/479, 313

(56) References Cited

U.S. PATENT DOCUMENTS 5,025,490 A 6/1991 Tamura ..... 313/479

FOREIGN PATENT DOCUMENTS

| | | |
|---|---|---|
| JP | 04-174945 | 6/1992 |
| JP | 05-041187 | 2/1993 |
| JP | 08-287850 | 11/1996 |
| JP | 09-213244 | 8/1997 |

*Primary Examiner*—Vip Patel
(74) *Attorney, Agent, or Firm*—Robert E. Bushnell, Esq.

(57) ABSTRACT

A cathode-ray tube for preventing electrification and shielding electromagnetic waves and manufacturing method thereof are provided. A cathode ray tube of the invention includes a transparent conductive film and a transparent insulating protective film, an electrode formed on at least a part of an inactive screen and on sides of the panel portion before the transparent conductive film and the transparent insulating protective film are coated; and a conductive tape coated with a conductive adhesive, electrically connecting the electrode and an, explosive-proof band. According to this invention, a panel of the cathode ray tube is grounded by an electrode being in direct contact with a transparent conductive film, which provides more effective grounding than that through a protective film. At the same time, the cathode ray tube panel can effectively suppresses static electricity buildup and blocks electromagnetic waves by providing a path to ground through which excess electric charge generated on the surface of a cathode-ray tube can easily flow off, while preventing damage to an electrode.

22 Claims, 3 Drawing Sheets

CATHODE RAY TUBE WHOSE PANEL PROVIDES INCREASED PROTECTION FROM ELECTRIC SHOCK AND REDUCED EMISSION OF ELECTROMAGNETIC WAVES

This application makes reference to, incorporates the same herein, and claims all benefits accruing under 35 U.S.C. §119 from my applications CATHODE-RAY TUBE PREVENTING ELECTRIFICATION AND REMOVING ELECTRON WAVE AND PREPARING PROCESS THEREOF filed with the Korean Industrial Property Office on Jan. 5, 2001 and there duly assigned Ser. No. 665/2001, and CATHODE-RAY TUBE PREVENTING ELECTRIFICATION AND REMOVING ELECTRON WAVE AND PREPARING PROCESS THEREOF filed with the Korean Industrial Property Office on Jan. 5, 2001 and there duly assigned Ser. No. 666/2001.

BACKGROUND OF THE INVENTION

1. Technical Field

The present invention relates to a cathode ray tube providing increased protection from electric shock and providing reduced emission of electromagnetic waves, and more particularly, to a cathode ray tube with a panel that provides increased protection from electric shock and provides reduced emission of electromagnetic waves, and a method for manufacturing the cathode ray tube.

2. Related Art

In order to scan the phosphor layer formed on an inner surface of a panel of a cathode ray tube (CRT) with electron beam, a high voltage is applied across a cathode and anode, causing the anode button to have a positive electric potential. The inner portion of the panel also has a positive electric potential because the anode button is connected with an aluminum film on the panel. As a result, a high negative electric potential is formed on the outer surface of the panel, which may give electric shocks to a user. To avoid this danger, the surface of the panel must be grounded.

We have found that it can be a challenge to design and manufacture an improved apparatus to avoid this danger. Efforts have been made to improve cathode ray tubes.

Exemplars of recent efforts in the art include U.S. Pat. No. 5,025,490 issued to Tamura entitled CATHODE-RAY TUBE WITH ITS DISPLAY FRONT PROTECTED FROM UNDESIRABLE ELECTRIFICATION, Japanese Patent Publication No. 04-174945 entitled ANTISTATIC TYPE CATHODE-RAY TUBE listing inventors Hirasawa et al., Japanese Patent Publication No. 05-041187 entitled CATHODE RAY TUBE listing inventors Takamura et al., Japanese Patent Publication No. 08-287850 entitled CATHODE-RAY TUBE, DISPLAY UNIT, AND MANUFACTURE OF CATHODE-RAY TUBE listing inventors Saito et al., and Japanese Patent Publication No. 09-213244 entitled PANEL FOR CATHODE-RAY TUBE AND ITS MANUFACTURE listing inventors Imamura et al.

While these recent efforts provide advantages, I note that they fail to adequately provide a cathode ray tube with a panel that provides increased protection from electric shock and provides reduced emission of electromagnetic waves, and a method for manufacturing the cathode ray tube.

SUMMARY OF THE INVENTION

To solve the above problems and others, it is an objective of the present invention to provide a cathode ray tube whose panel provides increased protection from electric shock and reduced emission of electromagnetic waves by completely grounding a conductive film of a multi-layered film formed on an outer surface of a panel portion of a cathode ray tube (CRT), while not damaging the multi-layered film and an electrode.

To solve the above problems and others, it is an objective of the present invention to provide a manufacturing method of a cathode ray tube whose panel provides increased protection from electric shock and reduced emission of electromagnetic waves by completely grounding a conductive film of a multi-layered film formed on an outer surface of a panel portion of a cathode ray tube, while not damaging the multi-layered film and an electrode.

To achieve the above objectives and others, according to one embodiment, there is provided a cathode ray tube for preventing electrification and shielding electromagnetic waves wherein a transparent conductive film is formed on the outer surface of a panel portion and a transparent insulating protective film is formed on the transparent conductive film. The cathode ray tube includes an electrode formed on at least a part of an inactive screen and on sides of the panel portion before the transparent conductive film and the transparent insulating protective film are coated, and a conductive tape coated with a conductive adhesive for electrically connecting the electrode and an explosive-proof band.

At this time, it is preferable that the electrode is formed by applying conductive colloid or paste on the inactive screen of the panel portion. Also, the conductive colloid or paste preferably comprises particles of silver, gold, copper, nickel, palladium, platinum, ruthenium, or aluminum, or ruthenium oxide particles, or graphite or carbon black particles or fibers.

The electrode may be in direct contact with an explosive-proof band, and in this case, a general adhesive tape can be used instead of the conductive tape.

It is preferable that the conductive tape electrically connects the electrode with the explosive-proof band and at the same time, covers the transparent insulating protective film on the inactive screen of the panel portion in order to protect the electrode.

The above objectives and others can be also achieved by a method for manufacturing a cathode-ray tube for preventing electrification and shielding electromagnetic waves, comprising the steps of: applying conductive colloid or paste on at least a part of an inactive screen and on sides of a panel portion; coating the entire surface of the panel portion with a transparent conductive film and a transparent insulating protective film; sintering and hardening the surface of the panel portion; and attaching a conductive tape coated with a conductive adhesive to a formed electrode and connecting the conductive tape to an explosive-proof band.

At this time, it is preferable that the conductive tape covers the transparent insulating protective film on the inactive screen of the panel portion.

To achieve the above objectives and others, according to another embodiment, there is provided a cathode ray tube for preventing electrification and shielding electromagnetic waves including a transparent conductive film coated on the outer surface of a panel portion; a transparent insulating protective film coated on the transparent conductive film; an electrode formed on the outer surface of a panel portion by removing the transparent conductive film and the transparent insulating protective film on an inactive screen of the panel portion; and a conductive tape coated with a conductive adhesive electrically connecting the electrode and an explosive-proof band.

At this time, the electrode is preferably formed by applying conductive colloid or paste on the inactive screen of the panel portion. Also, the conductive colloid or paste preferably comprises particles of silver, gold, copper, nickel, palladium, platinum, ruthenium or aluminum, or ruthenium oxide particles, or graphite or carbon black particles or fibers.

Also, the electrode may be in direct contact with the explosive-proof band, and in this case, a general adhesive tape can be used instead of the conductive tape.

It is preferable that the conductive tape connects the electrode with the explosive-proof band and at the same time, covers the transparent insulating protective film on the inactive screen of the panel portion to protect the electrode.

To achieve the above objectives and others, there is provided a method for manufacturing a cathode-ray tube for preventing electrification and shielding electromagnetic waves including the steps of: coating the entire surface of a panel with a transparent conductive film and a transparent insulating protective film on the conductive film; forming an electrode by removing at least a part of the multi-layered film on an inactive screen of the panel portion and at the same time, applying conductive colloid or paste on the inactive screen where the multi-layered film is removed and on the sides of the panel; sintering and hardening the surface of the panel; and attaching a conductive tape coated with a conductive adhesive to the formed electrode and connecting the conductive tape to an explosive-proof band.

At this time, it is preferable that the conductive tape is applied to cover the transparent insulating protective film on the inactive screen of the panel portion.

To achieve these and other objects in accordance with the principles of the present invention, as embodied and broadly described, the present invention provides a cathode ray tube apparatus, comprising: a cathode ray tube having a panel portion; a first film being formed on an outer surface of the panel portion, said first film being transparent and conductive; a second film being formed on said first film, said second film being transparent and insulating; and an electrode being formed on at least a part of the panel portion before said first and second films are formed, said electrode being electrically connected to an explosive-proof band.

To achieve these and other objects in accordance with the principles of the present invention, as embodied and broadly described, the present invention provides a method, comprising: applying at least one selected from among a conductive colloid and a conductive paste on at least a part of an inactive screen portion and on sides of a panel portion of a cathode ray tube device; coating an entire surface of said panel portion with a transparent conductive film and with a transparent insulating protective film; sintering and hardening said surface of said panel portion; and attaching a conductive tape coated with a conductive adhesive to a formed electrode and connecting said conductive tape to an explosive-proof band.

To achieve these and other objects in accordance with the principles of the present invention, as embodied and broadly described, the present invention provides a cathode ray tube apparatus for preventing electrification and shielding electromagnetic waves, the apparatus comprising: a transparent conductive film being coated on an outer surface of a panel portion; a transparent insulating protective film being coated on said transparent conductive film; an electrode being formed on the outer surface of the panel portion by removing said transparent conductive film and said transparent insulating protective film on an inactive screen portion of the panel portion; and an adhesive tape adhering to said electrode and an explosive-proof band.

To achieve these and other objects in accordance with the principles of the present invention, as embodied and broadly described, the present invention provides a method for manufacturing a cathode-ray tube for preventing electrification and for shielding electromagnetic waves, the method comprising: coating a surface of a panel with a transparent conductive film, and coating a transparent insulating protective film on said transparent conductive film, to form a multi-layered film; forming an electrode by substantially simultaneously removing at least a part of the multi-layered film on an inactive screen portion of the panel and applying one of a conductive colloid and a conductive paste on the inactive screen portion where the multi-layered film is removed and on sides of the panel; sintering and hardening the surface of the panel; and attaching a conductive tape coated with a conductive adhesive to the formed electrode and connecting the conductive tape to an explosive-proof band.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

Figure 1:
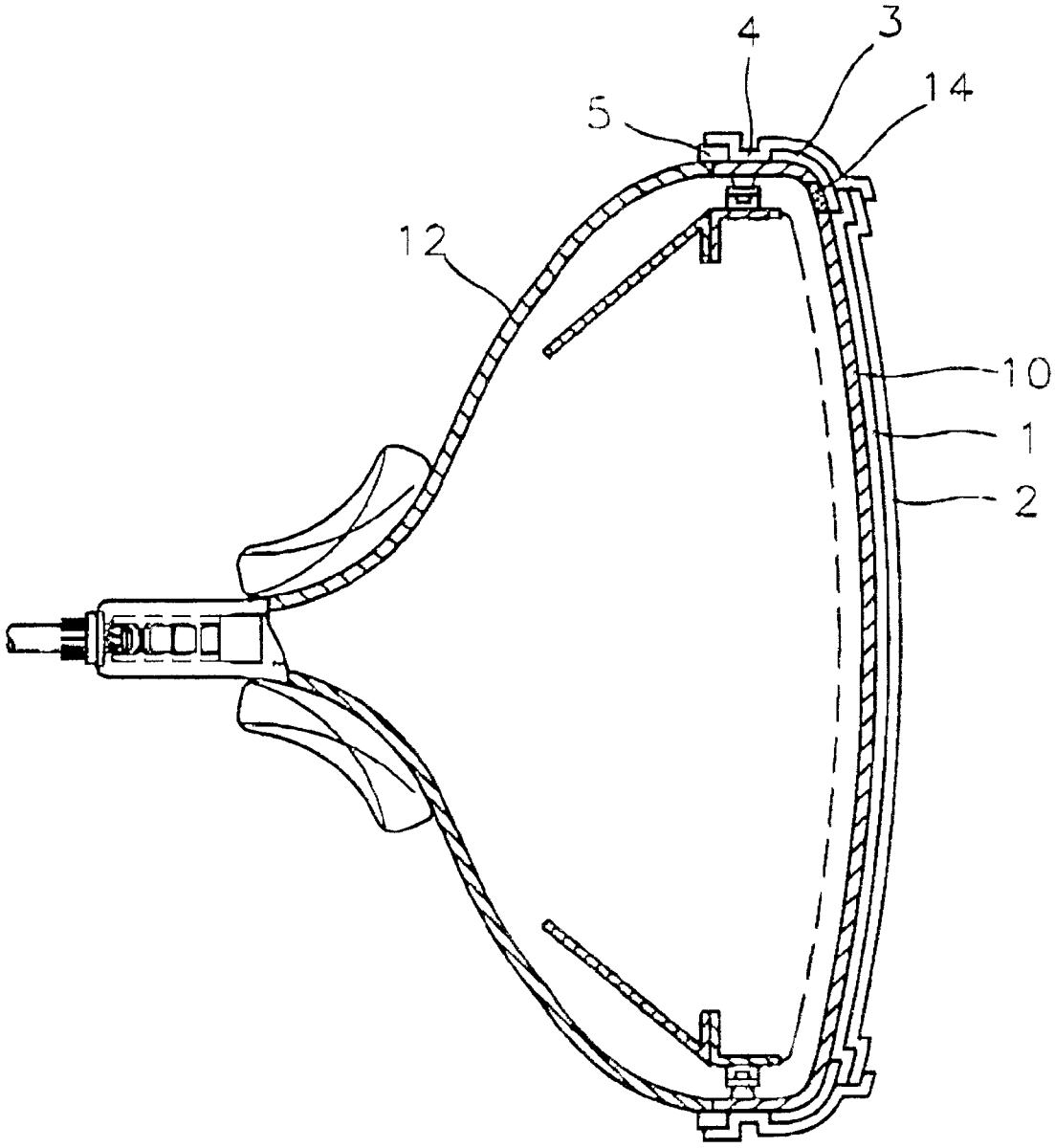
FIG. 1 is a cross-sectional view of a first preferred embodiment of a panel portion of a cathode ray tube, in accordance with the principles of the present invention.

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

In order to prevent formation of a high electric potential at the outer surface of a front display of a cathode ray tube, forming a transparent conductive film on the surface of a glass layer and then grounding this film can be proposed.

There can be a variety of grounding methods comprising forming a transparent conductive film, a transparent insulating protective film and an electrode over the surface of a panel of a cathode ray tube, attaching a metal tape coated with conductive adhesive to the formed result and grounding by connecting the metal tape with an explosive-proof band. Thus, excess electric charge flows out of the transparent conductive film through the metal electrode and the band. However, due to the insulating film between the transparent conductive film and the metal electrode, the transparent conductive film cannot be sufficiently grounded.

Hereinafter, the present invention will be described in detail by explaining preferred embodiments thereof with reference to the attached drawings. Like reference numerals in the drawings denote the same members.

A "multi-layered film" according to the present invention is a film composed of a transparent conductive film and a transparent insulating film that are formed on the outer surface of a panel portion. Materials for the multi-layered film are not limited. The materials for the multi-layered film can be any materials, as long as they satisfy the principles of the present invention. However, materials for a transparent conductive film are preferably tin-doped indium oxide, antimon-doped tin oxide (ATO) or the like, and a transparent insulating protective film is preferably formed of silica, aluminum, zirconia, titania or the like. Tin-doped indium oxide can be referred to as indium oxide-tin oxide film (ITO).

An electrode of the present invention rapidly removes electric charge from the surface of a cathode ray tube, thus preventing static electricity buildup and enhancing the shielding of electromagnetic waves. It is preferable that the electrode is formed by coating a conductive colloid or paste on all or some part of inactive screen surface and the sides of the panel. The colloid or paste is formed by mixing conductive particles or fibers with binder. The conductive particles or fibers can be any materials, as long as they satisfy the principles of the present invention. Although there is no limit, particles of at least one metal selected from the group consisting of silver, gold, copper, nickel, palladium, platinum, ruthenium and aluminum, or ruthenium oxide particles, or particles or fibers of graphite or carbon black can be used.

FIG. 1 is a cross-section of a panel portion of a cathode ray tube according to a first embodiment of the present invention reviewed from above. Referring to FIG. 1, a cathode ray tube 12 has a panel portion 10. The panel portion 10 has an inactive screen portion 14. The outer surface of the panel portion 10 of the cathode ray tube 12 has a film structure where a transparent conductive film 1 directly contacts an electrode 3 because the electrode 3 is formed before the transparent conductive film 1 is coated. This structure shows a superior grounding effect compared to a structure including a transparent insulating protective film 2 interposed between a transparent conductive film and an electrode.

As shown in FIG. 1, a conductive tape 4 which electrically connects an electrode 3 with an explosion-proof band 5, can be formed to cover some part of the transparent insulating protective film 2 as well as the electrode 3, which prevents damage to the electrode 3. The explosive-proof band 5 can also be referred to as a tension band, which can be part of a protection system that helps to avoid injury.

Further, a structure which is directly grounded by extending an electrode 3 to the explosive-proof band 5, can be derived. In this case, an adhesive tape which protects, as well as a conductive tape, can be used.

Figure 2:
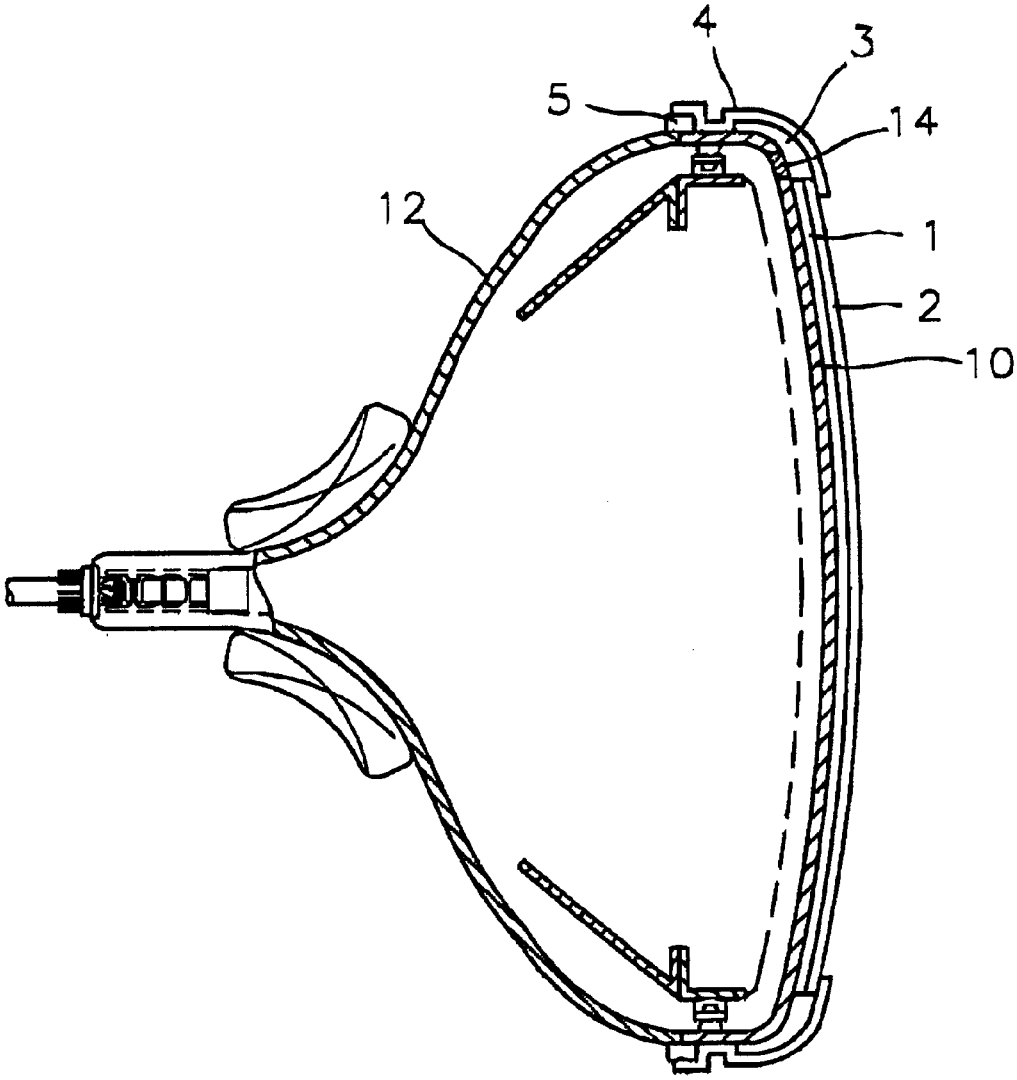
FIG. 2 is a cross-sectional view of a second preferred embodiment of a panel portion of a cathode ray tube, in accordance with the principles of the present invention.
Figure 3:
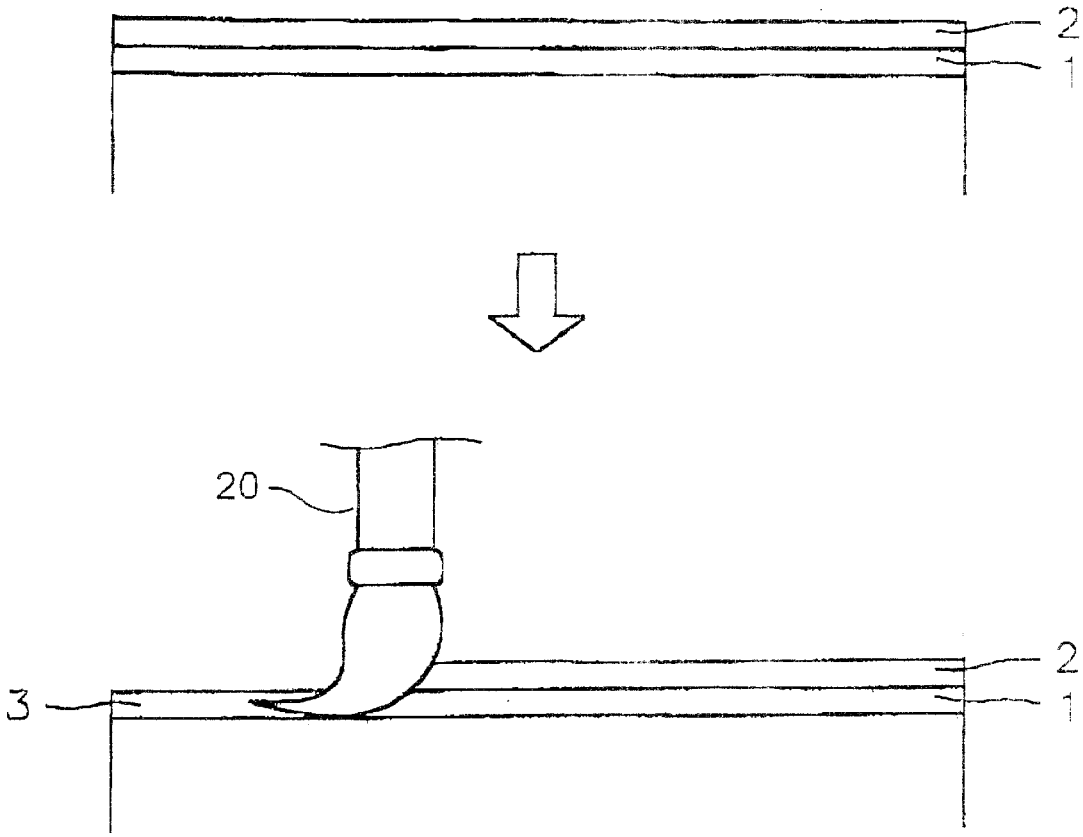
FIG. 3 is a view of the films and the electrode, in accordance with the principles of the present invention.

FIG. 2 is a cross-section of a panel portion of a glass bulb 12 according to a second preferred embodiment of the present invention. Referring to FIG. 2, a transparent conductive film 1 and a transparent insulating protective film 2 are spin-coated or spray-coated on a panel portion 10. The multi-layered film (1 and 2) on all or some part of inactive screen surface is peeled off to form an electrode and then finally hardened. For example, when conductive colloid or paste is painted to the inactive screen of the panel with a brush 20 before the multi-layered film is hardened, the multi-layered film 1 and 2 on the inactive screen is peeled off by the brush while an electrode 3 directly connected with the transparent conductive film 1 is formed as shown in FIG. 3.

The panel portion of the cathode-ray tube formed in the above-described manner facilitates the flow of electricity because the transparent conductive film 1 as well as the transparent insulting protective film 2 and the electrode are in direct contact with each other.

After hardening the panel described above by sintering or the like, the formed electrode 3 is connected to an explosive-proof band 5 by attaching a conductive tape 4 coated with a conductive adhesive to the electrode and the explosive-proof band 5. As shown in FIG. 2, the conductive tape 4 can be formed to cover a part of the transparent protective film 2, thus preventing damage to the electrode.

Further, a structure which is directly grounded by extending an electrode 3 to an explosive-proof band 5, can be derived. In this case, a general adhesive tape, as well as a conductive tape, can be used.

The present invention now will be described in greater detail by means of the following examples. The following examples are for illustrative purposes and are not intended to limit the scope of the invention.

COMPARATIVE EXAMPLE 1

3.0 grams (g) of tin-doped indium oxide (ITO) particles containing 10at % (atomic percentage) was dispersed into a solution of 20 g of methanol, 67.9 g of ethanol and 10 g of n-butanol to obtain a first composition (hereinafter, "coating liquid A").

4.5 grams of tetraethyl orthosilicate was mixed with a solution that is 30 g of methanol, 50 g of ethanol, 12 g of n-butanol and 4 g of pure water. Subsequently, 0.6 g of nitric acid and 0.047 gof silver nitrate were added to the mixed result and stirred at room temperature for 24 hours to obtain a second composition (hereinafter, "coating liquid B").

A transparent conductive film was formed by pouring 50 cubic centimeters (cc) of coating liquid A onto a cleansed glass panel while rotating the glass panel at about 90 revolutions per minute (rpm) and then increasing the rotating speed of the glass panel to about 150 revolutions per minute, to coat the glass panel with coating liquid A. Then, a transparent insulating protective film was formed by pouring 60 cc of coating liquid B onto the coated glass panel while rotating the glass panel in the same way as in the formation of the transparent conductive film. The glass panel was then dried and sintered for thirty minutes while maintaining the surface temperature of the glass panel at 240° Celsius (C.), to form a transparent conductive thin film.

Grounding was accomplished by attaching a conductive tape coated with a conductive adhesive to the transparent insulating protective film, connecting the conductive tape to an explosive-proof band and grounding the explosive-proof band.

EXAMPLE 1

After silver paste was applied on a part of an inactive screen and sides of a panel portion of a cathode ray tube, coating liquid A and coating liquid B were formed in the same way as in comparative example 1 to be applied on the panel portion. A transparent conductive film, a transparent insulating protective film and an electrode were formed by sintering the panel at 240° C. for thirty minutes. Thereafter, the panel was grounded by attaching a conductive tape coated with conductive adhesive to the electrode within the inactive screen of the panel portion and the transparent insulating film and connecting the conductive tape to an explosive-proof band connected to ground.

EXAMPLE 2

Coating liquid A and coating liquid B were applied on a panel portion in the same way as in comparative example 1. Then silver paste was applied on a portion of the inactive screen and sides of the panel portion using a brush to form an electrode across 75% of the length of the inactive screen of the panel portion. A transparent conductive film, a transparent insulating protective film and an electrode were completed after sintering at 240° C. for 30 minutes. Thereafter, the panel was grounded by attaching a conductive tape coated with a conductive adhesive to the electrode and the transparent insulating protective film on the inactive screen of the panel portion, connecting the conductive tape to an explosive-proof band connected to ground.

The following table 1 shows the surface resistance of each of the transparent conductive thin films formed according to the above-described comparative example 1 and examples 1 and 2:

TABLE 1

| | Generation of Electromagnetic Wave (V/m) |
|---|---|
| Comparative Example 1 | 0.6 |
| Example 1 | 0.45 |
| Example 2 | 0.55 |

As described above, the present invention provides a panel of a cathode-ray tube which is grounded by an electrode being in direct contact with a transparent conductive film, which provides more effective grounding than in another type of cathode ray tube panel having a protective film interposed between an electrode and a transparent conductive film. Further, damage to an electrode can be prevented by attaching an adhesive tape directly to an electrode. Accordingly, the cathode ray tube panel according to the present invention effectively suppresses static electricity buildup and blocks or electromagnetic waves by providing a path to ground through which excess electric charge generated on the surface of a cathode-ray tube can easily flow off.

The foregoing paragraphs describe the details of a cathode ray tube (CRT) with a panel that provides increased protection from electric shock and provides reduced emission of electromagnetic waves, and a method for manufacturing the cathode ray tube, and more particularly, to a cathode ray tube with a panel that prevents the accumulation of charge on its surface thereby providing increased protection from electric shock and reduced emission of electromagnetic waves, and a method for manufacturing the cathode ray tube.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A cathode ray tube, comprising:

a glass bulb having a panel portion, the panel portion having an inactive screen portion;

a first film being formed on an outer surface of the panel portion, said first film being transparent and conductive;

a second film being formed on said first film, said second film being transparent and insulating and protective; and an electrode being formed on at least a part of the panel portion before said first and second films are formed, said electrode being electrically connected to an explosive-proof band.

2. The cathode ray tube of claim 1, further comprising a conductive tape, said tape being coated with a conductive adhesive, said tape electrically connecting said electrode with an explosive-proof band.

3. The cathode ray tube of claim 2, said tape covering said second film on at least a part of the inactive screen portion to protect said electrode.

4. The cathode ray tube of claim 1, further comprised of said electrode being formed by applying at least one selected from among a conductive colloid and a conductive paste on the inactive screen portion.

5. The cathode ray tube of claim 4, said conductive colloid and paste including particles of at least one metal, wherein said metal is selected from the group consisting of silver, gold, copper, nickel, palladium, platinum, ruthenium and aluminum, and ruthenium oxide particles.

6. The cathode ray tube of claim 4, said conductive colloid and paste including at least one selected from among graphite, carbon black particles, and fibers.

7. The cathode ray tube of claim 1, said electrode being in direct contact with the explosive-proof band.

8. The cathode ray tube of claim 7, further comprising a tape adhering to said electrode and to the explosive-proof band.

9. The cathode ray tube of claim 8, said tape being a conductive tape and being coated with an electrically conductive adhesive.

10. The cathode ray tube of claim 8, said tape being a general adhesive tape.

11. The cathode ray tube of claim 10, said tape covering said second film on at least a part of the inactive screen portion to protect said electrode.

12. A method, comprising:

applying at least one selected from among a conductive colloid and a conductive paste on at least a part of an inactive screen portion and on sides of a panel portion of a cathode ray tube device, said cathode ray tube device providing protection against electromagnetic waves and against electric shock;

coating an entire surface of said panel portion with a transparent conductive film and subsequently with a transparent insulating protective film;

sintering and hardening said surface of said panel portion; and attaching a conductive tape coated with a conductive adhesive to a formed electrode and connecting said conductive tape to an explosive-proof band.

13. The method of claim 12, wherein said conductive tape covers said transparent insulating protective film on said inactive screen portion of said panel portion.

14. A cathode ray tube for preventing electrification and shielding electromagnetic waves, the cathode ray tube comprising:

a transparent conductive film being coated on an outer surface of a panel portion;

a transparent insulating protective film being coated on said transparent conductive film;

an electrode being formed on the outer surface of the panel portion by removing said transparent conductive film and said transparent insulating protective film on an inactive screen portion of the panel portion; and an adhesive tape adhering to said electrode and an explosive-proof band.

15. The cathode ray tube of claim 14, said adhesive tape being a conductive tape coated with a conductive adhesive, said adhesive tape electrically connecting said electrode with the explosive-proof band.

16. The cathode ray tube of claim 15, said conductive tape electrically connecting said electrode with the explosive-proof band and, at the same time, covering said transparent insulating protective film on the inactive screen portion of the panel portion to protect said electrode.

17. The cathode ray tube of claim 15, said electrode being formed by applying one selected from among a conductive colloid and a conductive paste on the inactive screen portion of the panel portion.

18. The cathode ray tube of claim 17, said conductive colloid and paste including particles of at least one metal, wherein said metal is selected from the group consisting of silver, gold, copper, nickel, palladium, platinum, ruthenium and aluminum, and ruthenium oxide particles.

19. The cathode ray tube of claim 17, said conductive colloid and paste including at least one selected from among graphite, carbon black particles, and fibers.

20. The cathode ray tube of claim 14, said electrode being in direct contact with the explosive-proof band.

21. A method for manufacturing a cathode-ray tube for preventing electrification and for shielding electromagnetic waves, the method comprising:

coating a surface of a panel with a transparent conductive film, and coating a transparent insulating protective film on said transparent conductive film, to form a multi-layered film;

forming an electrode by simultaneously removing at least a part of the multi-layered film on an inactive screen portion of the panel and applying one of a conductive colloid and a conductive paste on the inactive screen portion where the multi-layered film is removed and on sides of the panel;

sintering and hardening the surface of the panel; and attaching a conductive tape coated with a conductive adhesive to the formed electrode and connecting the conductive tape to an explosive-proof band.

22. The method of claim 21, said attaching of the conductive tape being performed to cover at least a part of the transparent insulating protective film on the inactive screen portion of the panel.

* * * * *